US011596237B1

(12) United States Patent
Davidson et al.

(10) Patent No.: US 11,596,237 B1
(45) Date of Patent: Mar. 7, 2023

(54) STOOL WITH TWO SEATING SURFACES

(71) Applicant: KLD IP Holdings, LLC, Neosho, MO (US)

(72) Inventors: Richard D. Davidson, Neosho, MO (US); Dustin C. McDermott, Granby, MO (US)

(73) Assignee: KLD IP Holdings, LLC, Neosho, MO (US)

( * ) Notice: Subject to any disclaimer, the term of this patent is extended or adjusted under 35 U.S.C. 154(b) by 0 days.

(21) Appl. No.: 17/671,116

(22) Filed: Feb. 14, 2022

(51) Int. Cl.
*A47C 9/00* (2006.01)

(52) U.S. Cl.
CPC ..... *A47C 9/00* (2013.01)

(58) Field of Classification Search
CPC .. A47C 3/04; A47C 3/16; A47C 13/00; A47C 9/00; A47D 1/04
USPC ..... 297/183.1, 183.6, 239, 283.1
See application file for complete search history.

(56) References Cited

U.S. PATENT DOCUMENTS

| | | | | | |
|---|---|---|---|---|---|
| 4,867,504 | A * | 9/1989 | Johnson, Jr. | A47D 1/103 | 297/239 |
| 4,950,033 | A * | 8/1990 | Anderson | A47C 7/008 | 297/223 |
| 5,749,555 | A * | 5/1998 | Albrecht | A47C 9/025 | 482/52 |
| D700,435 | S * | 3/2014 | Gold | D3/307 | |
| D707,975 | S * | 7/2014 | Habraken | D6/353 | |
| D746,593 | S * | 1/2016 | Kroll | D3/307 | |
| 2013/0137558 | A1* | 5/2013 | Ross | A63B 5/16 | 482/142 |

* cited by examiner

*Primary Examiner* — Sarah B McPartlin
(74) *Attorney, Agent, or Firm* — Martin & Associates, LLC; Derek P. Martin

(57) ABSTRACT

A stool provides two different seating surfaces at different heights depending on the orientation of the stool. In a first orientation with a bottom of the stool down, the top of the stool provides a first seating surface at a first height. In a second orientation with a back of the stool down, the front of the stool provides a second seating surface at a second height.

18 Claims, 9 Drawing Sheets

STOOL WITH TWO SEATING SURFACES

BACKGROUND

1. Technical Field

This disclosure generally relates to seating, and more specifically relates to stools.

2. Background Art

Mankind has invented various types of seating throughout the centuries. Schools have typically used desks as seating for students. Stools have long been used in a variety of settings for sitting up to tables, desks, bars, workbenches, etc. Most known stools have multiple legs or casters that all contact the floor to provide a stable base that maintains a single seat parallel to the floor or ground. Most known stools are not stackable, and are therefore unsuitable to many environments such as schools that have limited space.

BRIEF SUMMARY

A stool provides two different seating surfaces at different heights depending on the orientation of the stool. In a first orientation with a bottom of the stool down, the top of the stool provides a first seating surface at a first height. In a second orientation with a back of the stool down, the front of the stool provides a second seating surface at a second height.

The foregoing and other features and advantages will be apparent from the following more particular description, as illustrated in the accompanying drawings.

BRIEF DESCRIPTION OF THE SEVERAL VIEWS OF THE DRAWING(S)

The disclosure will be described in conjunction with the appended drawings, where like designations denote like elements, and:

DETAILED DESCRIPTION

A stool provides two different seating surfaces at different heights depending on the orientation of the stool. In a first orientation with a bottom of the stool down, the top of the stool provides a first seating surface at a first height. In a second orientation with a back of the stool down, the front of the stool provides a second seating surface at a second height.

Figure 1:
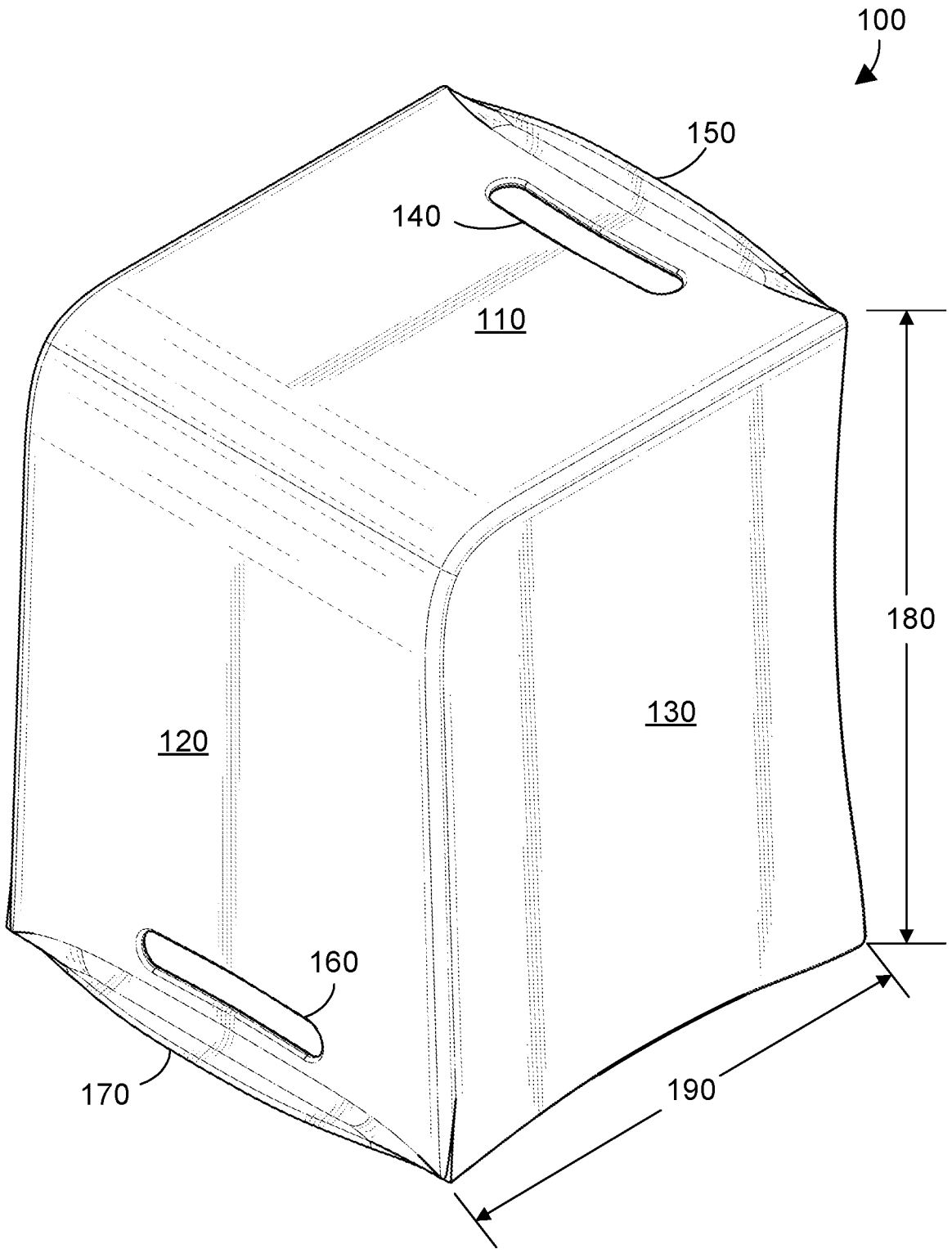
FIG. 1 is an upper perspective view of a stool in accordance with an embodiment of the invention, where the stool is oriented on its bottom to provide a first seating surface at a first height.
Figure 5:
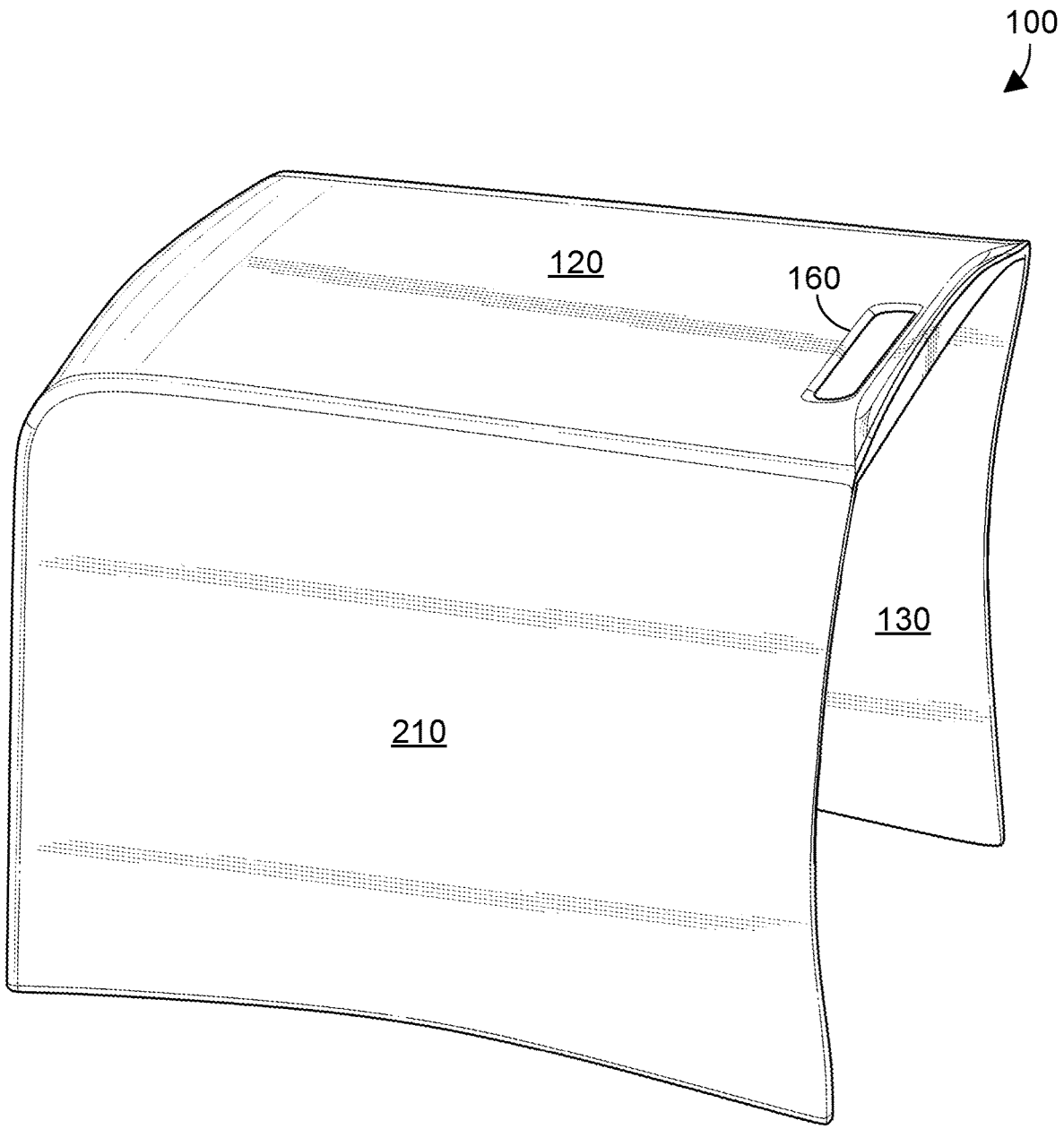
FIG. 5 is a side perspective view showing the stool in FIGS. 1-4 oriented on its back to provide a second seating surface at a second height.

FIG. 1 is an upper perspective view of a stool 100 in accordance with a preferred embodiment of the invention. The stool 100 includes a top 110 that comprises a first seating surface, a front 120 that comprises a second seating surface, and a side 130. The first seating surface preferably comprises the top surface of the top 110. The second seating surface preferably comprises the surface of the front 120. The top 110 includes an opening 140 that can act as a handhold, allowing a person to lift the stool by placing one or more fingers through the opening 140, bending the finger(s), then lifting the stool 100. The top 110 further includes an edge flange 150 that provides structural reinforcement due to the back of the stool being substantially open, as discussed in more detail below. Similarly, the front 120 includes an opening 160 for a handhold and an edge flange 170. While the openings 140 and 160 that are used as handholds are shown as oval openings that allow a person to insert all four fingers into the openings to lift the stool, other configurations are also possible that could accommodate one or multiple fingers or finger/thumb combinations to allow for easily lifting the stool. The side 130 has a height 180 and a width 190. In one implementation, the height 180 and width 190 are the same. In the most preferred implementation, the height 180 of the side 130 is greater than the width 190 of the side. Thus, when the stool 100 is in a first orientation as shown in FIG. 1, the top surface 110 provides the first seating surface at a first height that is determined by the height 180 of the side 130. When the stool 100 is in the second orientation as shown in FIG. 5, the front 120 provides the second seating surface at a second height that is determined by the width 190 of the side 130 shown in FIG. 1. In the most preferred implementation, the first seating surface and the second seating surface are in planes that are substantially perpendicular to each other. The term "substantially perpendicular" as used herein does not mean exactly perpendicular, but is used to denote the first seating surface and the second surface are in planes that are within plus or minus twenty degrees of perpendicular to each other.

Said another way, the first orientation is at a substantial right angle with respect to the second orientation. The term "substantial right angle" as used herein does not mean an exact right angle, but is used to denote the first seating surface and the second seating surface are at an angle with respect to each other that includes a right angle plus or minus twenty degrees.

Figure 2:
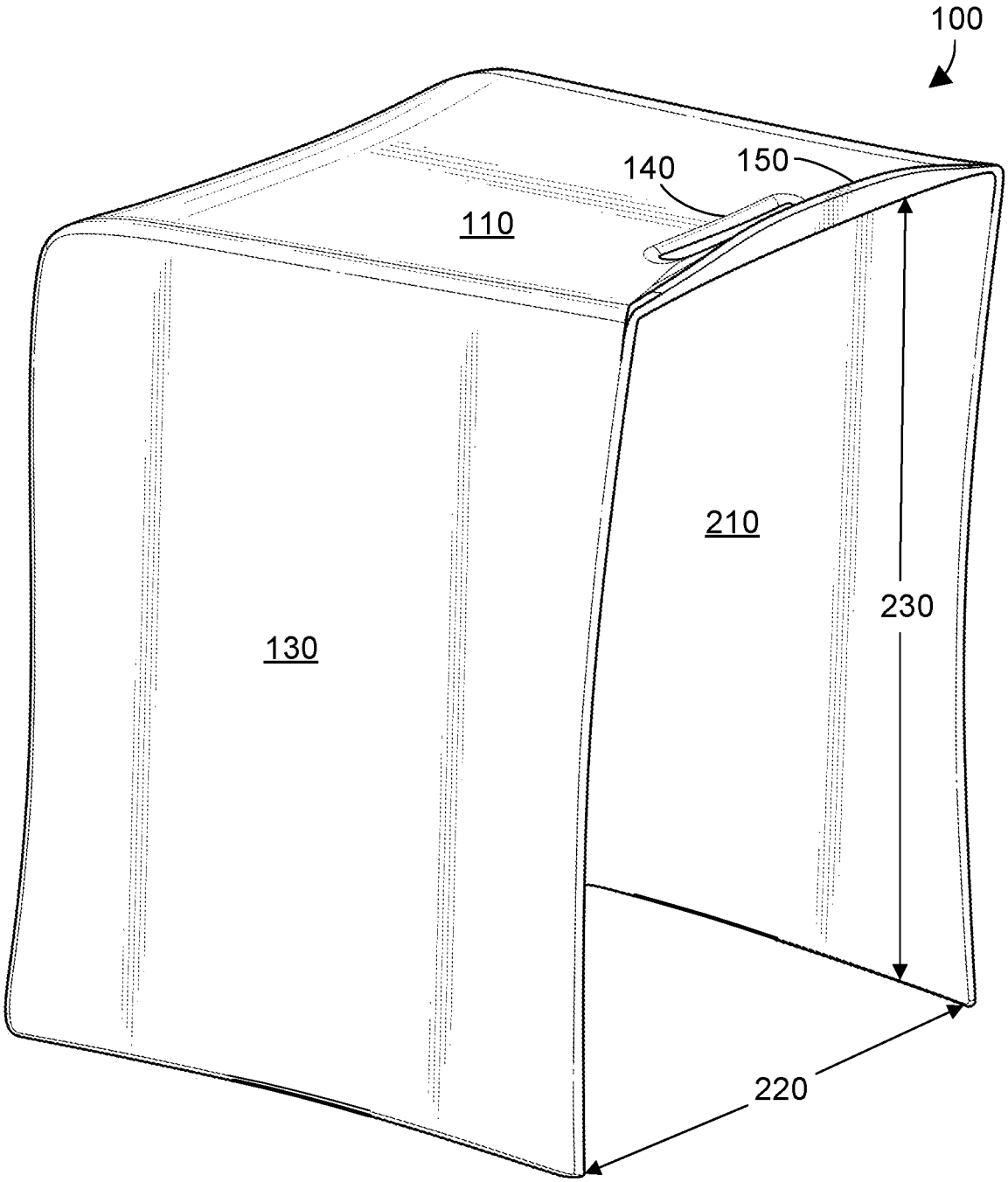
FIG. 2 is a side and back perspective view of the stool in FIG. 1.

FIG. 2 shows a side and rear perspective view of the stool 100 that shows both the back and the bottom are preferably substantially open, as shown by the height 230 having no structural member on the back other than the flange 150 on the top 110 and the width 220 having no structural member on the bottom other than the flange 170 on the front 120 (see FIG. 1). The side 210 that is opposite the side 130 in FIG. 1 is not visible in FIG. 1 but is shown in FIG. 2.

Figure 3:
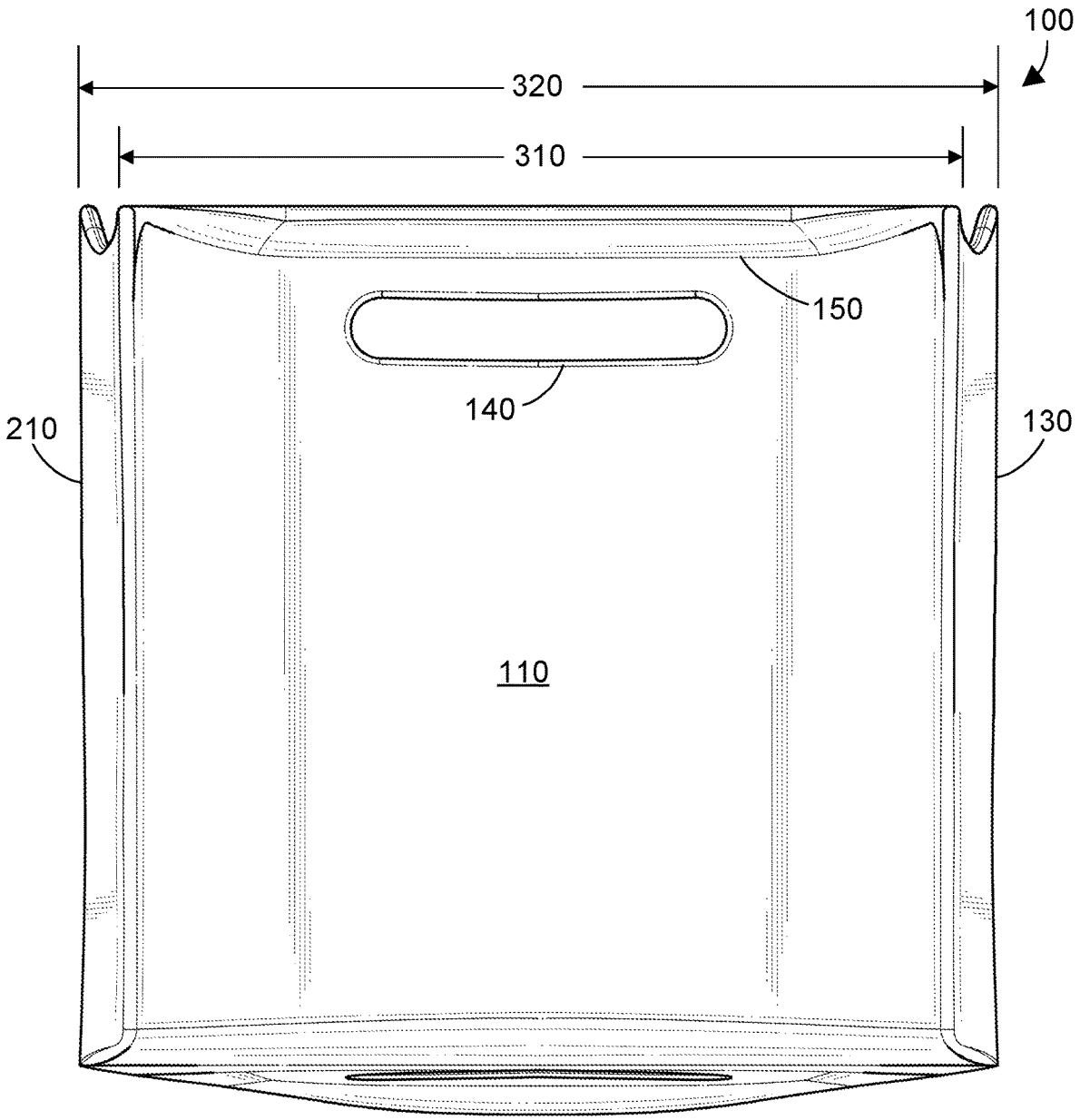
FIG. 3 is a top view of the stool shown in FIGS. 1 and 2.
Figure 4:
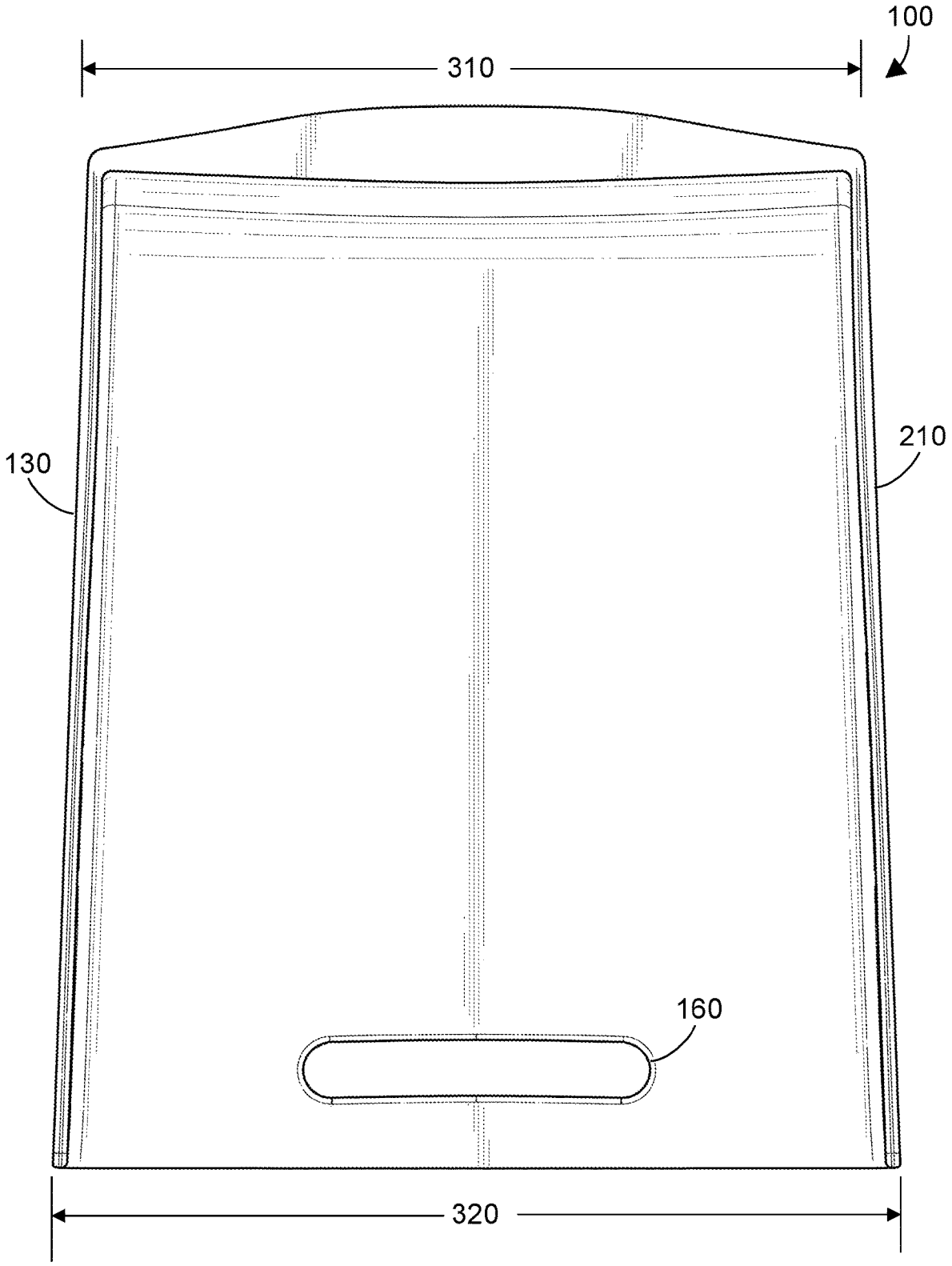
FIG. 4 is a back view of the stool in FIGS. 1-3.
Figure 6:
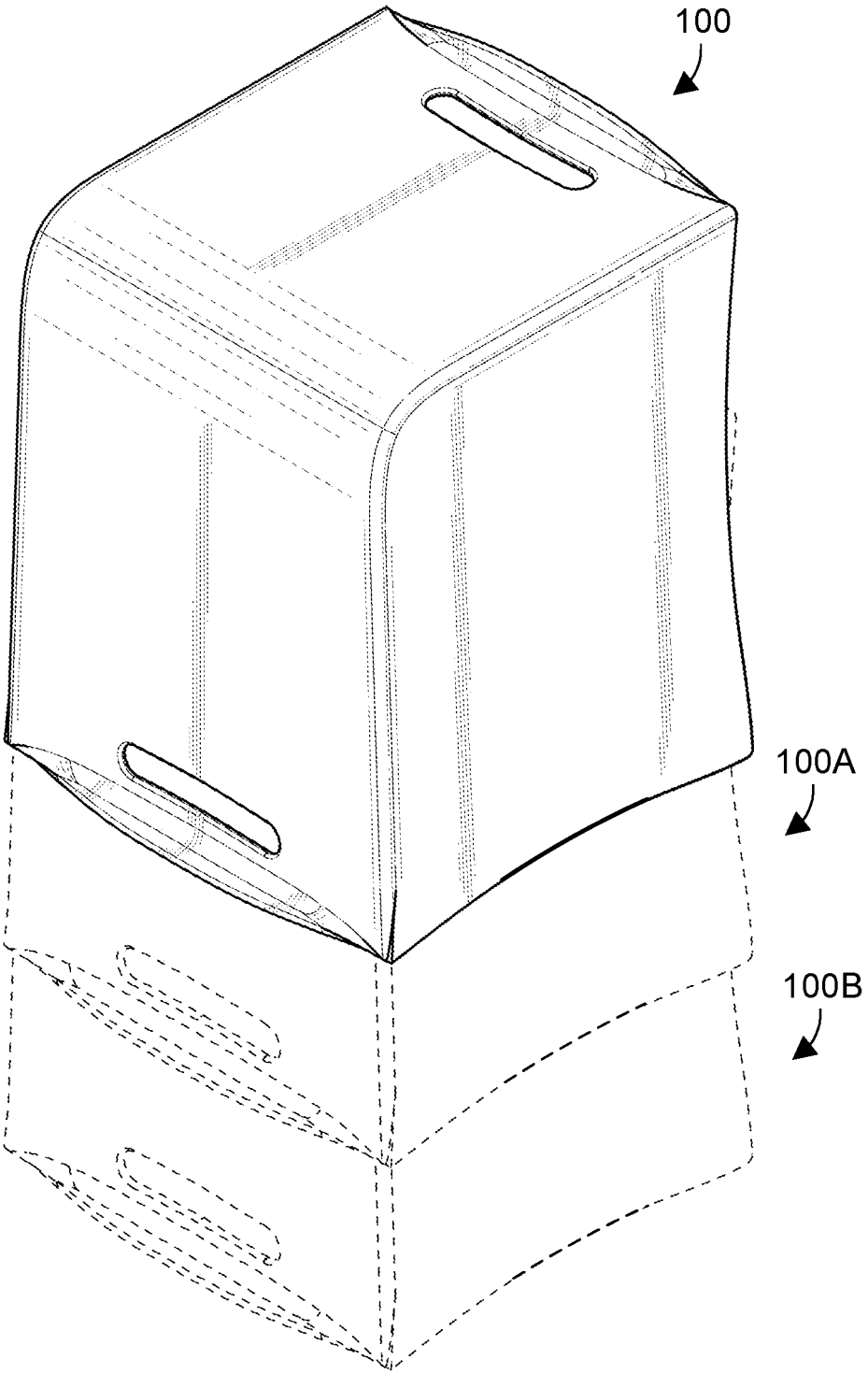
FIG. 6 is an upper perspective view of the stool stacked on two similar stools.

FIG. 3 shows a top view of the stool 100. One suitable feature of stool 100 is that the stool is smaller at the top than at the bottom. This is shown in FIGS. 3 and 4 by the top of the sides 130 and 210 being a first distance 310 apart, while the bottom of the sides 130 and 210 are a second distance 320 apart. Thus, the top portion of the front 120 that connects to the top 110 is narrower (e.g., 310) than a bottom portion of the front 120 that connects the two sides 130 and 210 (e.g., 320). As a result, first side 130 and second side 210 taper from narrower at the top of the front to wider at the bottom of the front. The sides 130 and 210 thus taper from narrower to wider from top to bottom. The combination of the substantially open back, the substantially open bottom, and the tapered sides makes the stool stackable. FIG. 6 shows stool 100 stacked atop a similar stool 100A, which is stacked atop a similar stool 100B. The stool 100 can thus be stacked to any suitable height. Note the stools could also be stacked in the orientation with their backs down as shown in FIG. 5.

The term "substantially open" as used herein does not require the back and bottom to be completely open, but to be mostly open. For example, a lip could extend from the front 100 towards the back a short distance, and a lip could extend down from the top 110 towards the bottom a short distance. In this particular example, the bottom and back are substantially open notwithstanding there are members on the bottom and back. In the most preferred implementation, the bottom and back are both preferably 80% or more open.

The stool 100 is very versatile because it can be used in two different orientations that provide different seating surfaces at different heights. FIG. 1 shows a first orientation, where the bottom is placed down and the first seating surface on the top 110 is used. FIG. 5 shows a second orientation, where the back is placed down and the second seating surface on the front 120 is used. The ability to orient the stool to two different seating heights is especially useful in a school environment, where the stool might be used in the second orientation shown in FIG. 5 when used by a tall student and might be used in the first orientation shown in FIGS. 1, 2 and 4 by a shorter student. Even if the same student uses the stool all day long, the student could use the stool in the first orientation at a table or desk that provides a higher work surface and could use the stool in the second orientation at a table that provides a lower work surface.

Figure 7:
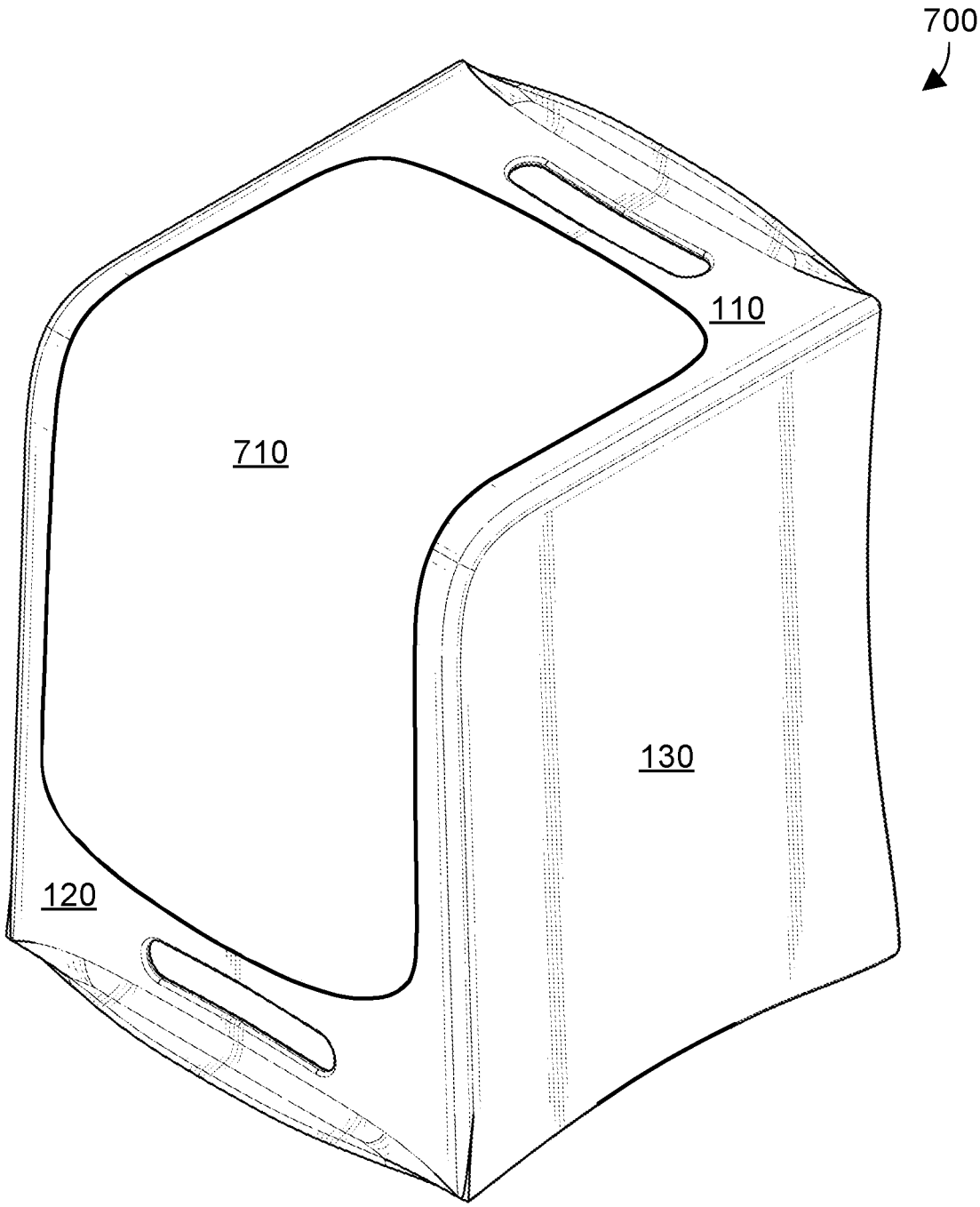
FIG. 7 is an upper perspective view of the stool showing a pad that covers both the first and second seating surfaces.

In one specific implementation, the stool can include a pad for one or both of the seating surfaces, making the stool more comfortable to the user. FIG. 7 shows a stool 700 that is a variation of stool 100 shown in FIGS. 1-6. Stool 700 includes a pad 710 that covers both the first seating surface on the top 110 and the second seating surface on the front 120. By providing a pad that covers both seating surfaces, the user can enjoy a padded seat with the stool in both orientations shown in FIGS. 1 and 5. The pad 710 is optional. In addition, separate pads could be provided on the top and front instead of the single pad shown in FIG. 7.

Figure 8:
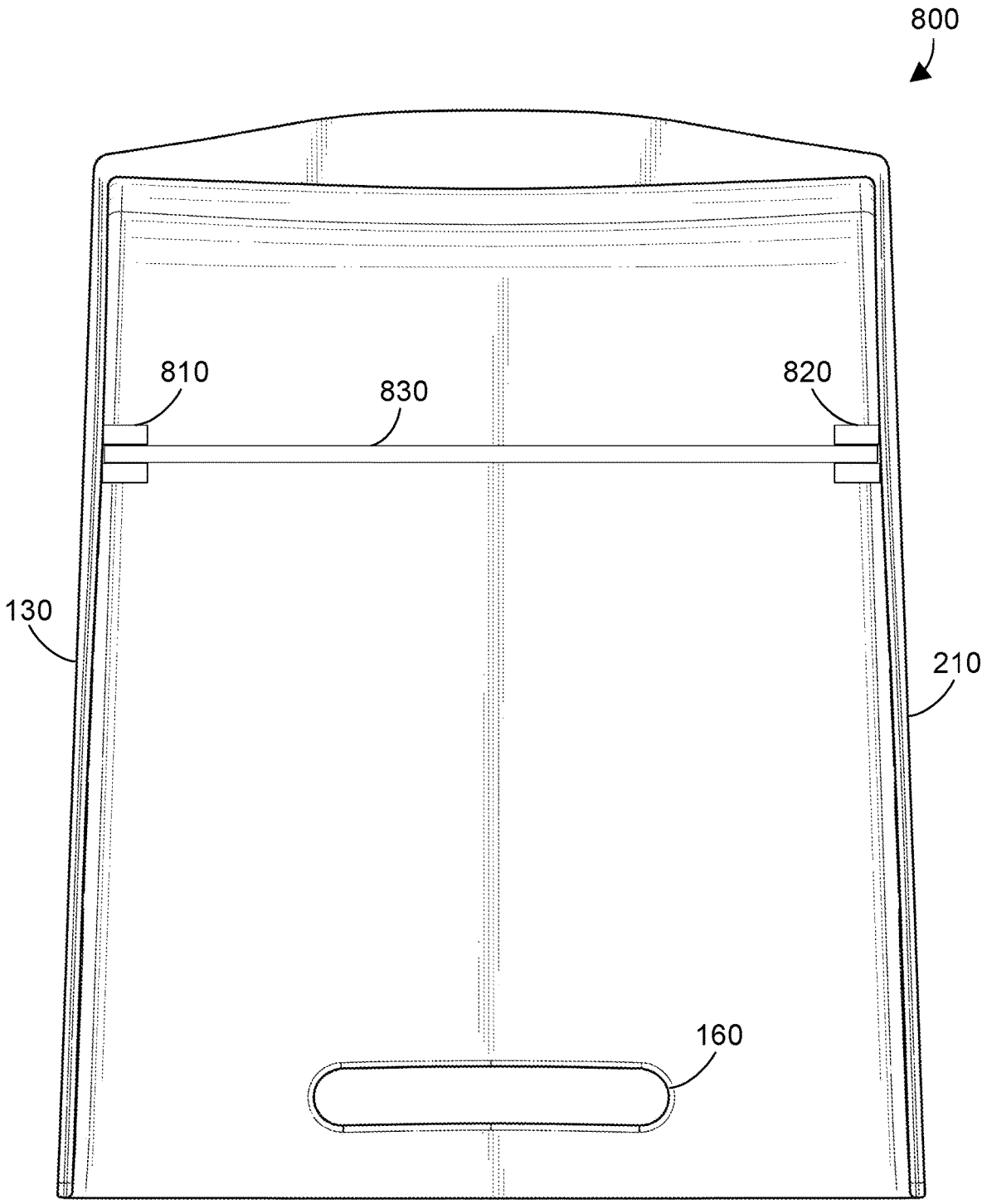
FIG. 8 is a back view of the stool showing shelf brackets that support a shelf.

In another specific implementation, the stool can include one or more shelf brackets that support a shelf. FIG. 8 shows a stool 800 that includes a shelf bracket 810 on the inside of side 130 and a shelf bracket 820 on the inside of side 210. A shelf 830 can then be installed by sliding in the shelf 830 between the shelf brackets 810 and 820, as shown in FIG. 8. In one specific implementation, the shelf 830 is permanently installed in stool 800. In the most preferred implementation, the shelf 830 is removable, and can be used or not used according to the user's preference. Any suitable coupling can be used to attach the shelf 830 to the shelf brackets 810 and 820. For example, the shelf 830 could include raised portions that correspond to recesses or holes in the shelf brackets 810 and 820 such that when the shelf 830 is slid into place, the raised portions of shelf 830 engage the recesses or holes in the shelf brackets 810 and 820, thereby retaining the shelf 830 in a desired position.

While a single shelf is shown in FIG. 8, multiple shelves could also be provided in stool 800. In addition, while the stool 800 is shown with a shelf 830 that is substantially parallel to the first seating surface on the top 110 when the shelf 830 is in the first orientation, it is also within the scope of the disclosure and claims herein to provide a shelf that is substantially parallel to the front 120 such that the shelf may be used with the stool 800 is in the second orientation shown in FIG. 5.

The position of the shelf brackets can be such that the shelf brackets rest atop the top 110 of another stool when stacked. With the shelf towards the top as shown in FIG. 8, the stool remains stackable with other stools. Of course, it is equally within the scope of the disclosure and claims herein to position the shelf brackets much lower than shown in FIG. 8, even though that could interfere with the ability of the stools to be stacked.

Figure 9:
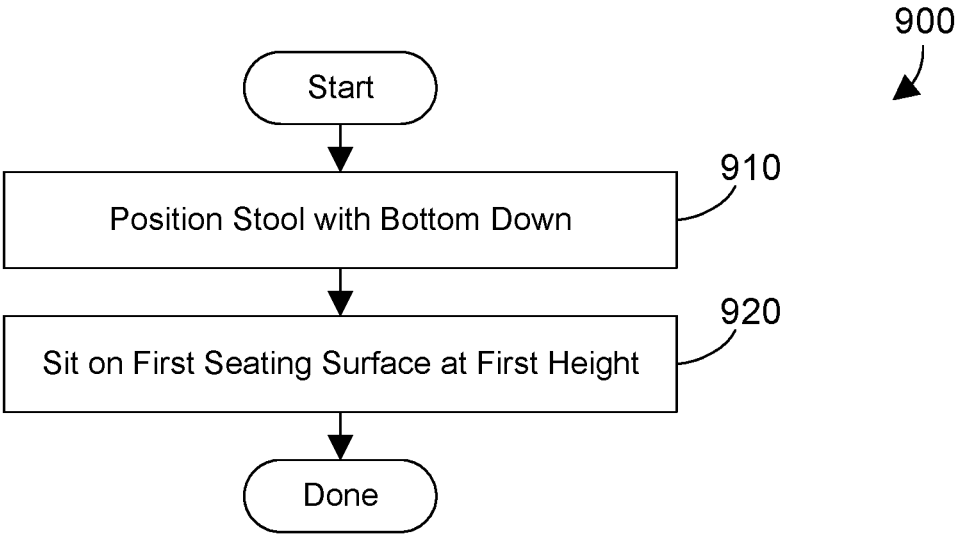
FIG. 9 is a flow diagram of a method for using the stool so a first seating surface is provided at a first height.
Figure 10:
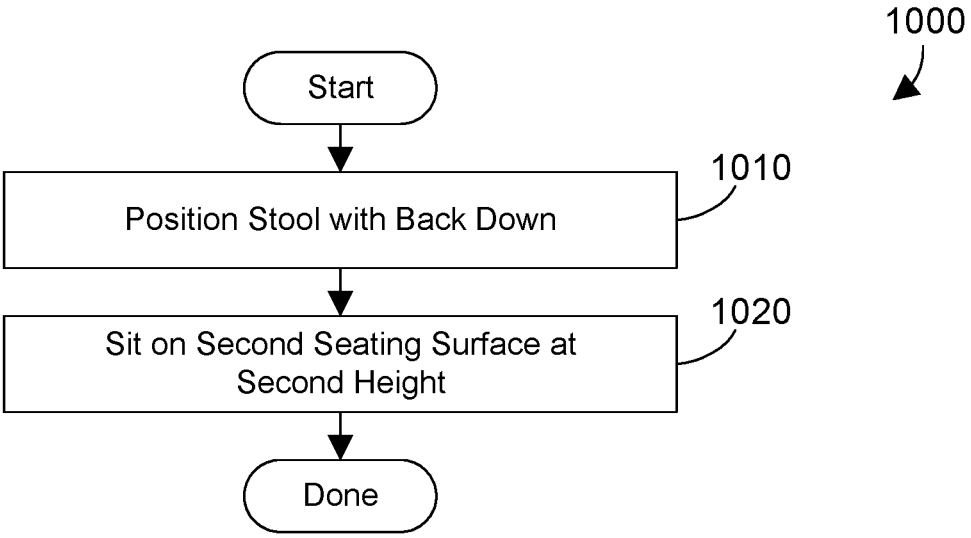
FIG. 10 is a flow diagram of a method for using the stool so a second seating surface is provided at a second height.

The versatility of the stool is shown, in part, by methods 900 and 1000 in FIGS. 9 and 10, respectively. Referring to FIG. 9, the stool is positioned with its bottom down (step 910), which corresponds to the first orientation described herein and shown by way of example in FIGS. 1, 2 and 4. The stool in the first orientation provides the first seating surface at a first height, and a person then sits on the first seating surface at the first height (step 920). Method 900 is then done. Referring to FIG. 10, the stool is positioned with its back down (step 1010), which corresponds to the second orientation described herein and shown by way of example in FIG. 5. The stool in the second orientation provides the second seating surface at a second height, and a person then sits on the second seating surface at the second height (step 1020). Method 1000 is then done.

The description herein and the examples shown in the figures use the terminology of top, bottom, front, back, and sides. This terminology is used by way of illustration to help the reader understand the specific examples disclosed herein. Thus, instead of the top 110 and front 120 described herein with respect to the figures, the second orientation shown in FIG. 5 could be described with a top 120 and a front 110. The labels and terminology used herein are not limiting, but are used to aid comprehension of the specific embodiments shown in the drawings. The disclosure and claims herein expressly extend to any stool that includes two different seating surfaces at two different orientations.

A stool provides two different seating surfaces at different heights depending on the orientation of the stool. In a first orientation with a bottom of the stool down, the top of the stool provides a first seating surface at a first height. In a second orientation with a back of the stool down, the front of the stool provides a second seating surface at a second height.

The disclosure and claims herein support a stool comprising: a first seating surface at a first height when the stool is in a first orientation; and a second seating surface different than the first seating surface, wherein the second seating surface is at a second height when the stool is in a second orientation.

The disclosure and claims herein further support a stool comprising: first and second sides; a top coupled to the first and second sides, wherein the top comprises a first seating surface; a front coupled to the first and second sides and coupled to the top, wherein the front comprises a second seating surface; wherein the stool is used in a first orientation with a bottom down making the first seating surface up; and wherein the stool is used in a second orientation with a back down making the second seating surface up.

The disclosure and claims herein additionally support a stool comprising: first and second sides that each have a height greater than their width; a top coupled to the first and second sides, wherein the top comprises a first seating surface; a front coupled to the first and second sides and coupled to the top, wherein the front comprises a second seating surface and a top of the front is narrower than a bottom of the front, thereby making the first and second sides taper from narrower to wider from top to bottom; a substantially open bottom between the front and the first and second sides; and a substantially open back between the top and the first and second sides; wherein the combination of the first and second sides tapering from narrower to wider from top to bottom, the substantially open bottom, and the substantially open back makes the stool stackable.

The disclosure and claims herein further support a method for using a stool comprising a first seating surface at a first height when the stool is in a first orientation and a second seating surface at a second height when the stool is in a second orientation, the method comprising: positioning the stool in the first orientation, thereby providing the first seating surface at the first height; and positioning the stool in the second orientation, thereby providing the second seating surface at the second height.

One skilled in the art will appreciate that many variations are possible within the scope of the claims. Thus, while the disclosure is particularly shown and described above, it will be understood by those skilled in the art that these and other changes in form and details may be made therein without departing from the spirit and scope of the claims.

The invention claimed is:

1. A stool comprising:

a first seating surface comprising a top at a first height when the stool is in a first orientation, wherein the first orientation is with a bottom of the stool down and the first seating surface comprises the top of the stool; and a second seating surface different than the first seating surface, wherein the second seating surface is at a second height when the stool is in a second orientation, wherein the second orientation is with a back of the stool down and the second seating surface comprises a front of the stool; and wherein a portion of the front that connects to the top of the stool is narrower than a bottom of the front, thereby making the stool stackable.

2. The stool of claim 1 further comprising an opening in the top of the stool that allows a person to lift the stool by placing at least one finger within the opening.

3. The stool of claim 1 wherein the bottom of the stool is substantially open.

4. The stool of claim 1 further comprising an opening in the front of the stool that allows a person to lift the stool by placing at least one finger within the opening.

5. The stool of claim 1 wherein the back of the stool is substantially open.

6. The stool of claim 1 wherein the first seating surface and the second seating surface are in planes that are substantially perpendicular to each other.

7. The stool of claim 1 wherein the first height and second height are different.

8. The stool of claim 1 wherein the first orientation is at a substantial right angle with respect to the second orientation.

9. A stool comprising:

first and second sides;

a top coupled to the first and second sides, wherein the top comprises a first seating surface;

a front coupled to the first and second sides and coupled to the top, wherein the front comprises a second seating surface;

wherein the stool is used in a first orientation with a bottom down making the first seating surface up;

wherein the stool is used in a second orientation with a back down making the second seating surface up; and wherein a top of the front is narrower than a bottom of the front, thereby making the first and second sides taper from narrower at the top of the front to wider at the bottom of the front, thereby making the stool stackable.

10. The stool of claim 9 wherein the sides have a height longer than their width.

11. The stool of claim 9 further comprising a substantially open bottom between the front and the first and second sides.

12. The stool of claim 9 further comprising a substantially open back between the top and the first and second sides.

13. The stool of claim 9 further comprising an opening in the top that allows a person to lift the stool by placing at least one finger within the opening.

14. The stool of claim 9 further comprising an opening in the front that allows a person to lift the stool by placing at least one finger within the opening.

15. The stool of claim 9 further comprising at least one shelf bracket on an interior of the first and second sides for supporting a shelf.

16. A stool comprising:

first and second sides that each have a height greater than their width;

a top coupled to the first and second sides, wherein the top comprises a first seating surface;

a front coupled to the first and second sides and coupled to the top, wherein the front comprises a second seating surface and a top of the front is narrower than a bottom of the front, thereby making the first and second sides taper from narrower to wider from top to bottom;

a substantially open bottom between the front and the first and second sides; and a substantially open back between the top and the first and second sides;

wherein the combination of the first and second sides tapering from narrower to wider from top to bottom, the substantially open bottom, and the substantially open back makes the stool stackable.

17. The stool of claim 16 wherein the stool is used in a first orientation with a the substantially open bottom down making the first seating surface up, and is used in a second orientation with a the substantially open back down making the second seating surface up.

18. The stool of claim 16 further comprising a first opening in the top that allows a person to lift the stool by placing at least one finger within the first opening and a second opening in the front that allows a person to lift the stool by placing at least one finger within the second opening.

* * * * *